US007886632B2

(12) United States Patent
Stoffers et al.

(10) Patent No.: US 7,886,632 B2
(45) Date of Patent: Feb. 15, 2011

(54) HANDLE GRIP

(75) Inventors: Michael Stoffers, Berlin (DE); Rainer Maurer, Berlin (DE); Uwe Gillmann, Berlin (DE)

(73) Assignee: CoActive Technologies, Inc., Newton, MA (US)

( * ) Notice: Subject to any disclaimer, the term of this patent is extended or adjusted under 35 U.S.C. 154(b) by 446 days.

(21) Appl. No.: 11/801,179

(22) Filed: May 9, 2007

(65) Prior Publication Data

US 2007/0283526 A1 Dec. 13, 2007

(30) Foreign Application Priority Data

May 11, 2006 (DE) ..... 10 2006 022 967

(51) Int. Cl.
*G05G 1/10* (2006.01)

(52) U.S. Cl. ..... 74/543; 248/118.3

(58) Field of Classification Search ..... 74/543, 74/551.3, 551.7, 471 XY; 248/292.12, 145.6, 248/118.3; 297/463.1, 463.2, 337, 338; 403/110
See application file for complete search history.

(56) References Cited

U.S. PATENT DOCUMENTS 3,353,684 A * 11/1967 Chesley ..... 248/243
5,304,174 A 4/1994 Estrada et al.
6,691,589 B2 * 2/2004 Gillman et al. ..... 74/471 XY

FOREIGN PATENT DOCUMENTS

GB 2377481 A 1/2003
WO 2005024541 A3 3/2005

* cited by examiner

*Primary Examiner*—Richard W Ridley
*Assistant Examiner*—Daniel Yabut
(74) *Attorney, Agent, or Firm*—Pepper Hamilton LLP

(57) ABSTRACT

A handle (10) for controlling a machine, has a largely vertical shaft (12) forming a grip part (11) and has an upper end forming a receptacle (14) that holds switch units (15-17) and a lower end forming a hand rest (20). The hand rest can be adjusted along the shaft (12) and can be detachably clamped to the shaft. The hand rest (20) comprises front and rear rest part (26, 27) that are pivotally, or swivelably, connected to one another. To prevent unintentional opening of the hand rest (20) by axial pressure on the latter, the two rest parts (26, 27) can be moved relative to one another in the axial direction to effect a locking and unlocking of their relative pivotabilities.

13 Claims, 3 Drawing Sheets

HANDLE GRIP

CROSS-REFERENCE TO RELATED APPLICATION

Applicant claims priority from German patent application DE 10 2006 0 22 967.3 filed May 11, 2006.

BACKGROUND OF THE INVENTION

The present invention relates to a handle grip, preferably for driveable construction machines, agricultural machines and the like. In particular, the invention relates to a handle grip with a grip part, at the upper end of which is provided a receptacle for switch units, and which is provided with a hand rest which can be adjusted with respect to the receptacle. Such handle grips, on which the operator rests his hand and can at the same time actuate individual switch units, are provided with a hand rest for supporting the edge of the hand. Conveniently in such a hand rest, the distance from the rest to the switch units to be operated with the thumb and possibly with other fingers can be adapted to the size of the operator's hand.

DE 101 27 515 Al discloses a handle grip having a one-piece rear rest part, which is pivotally, or swivelably coupled via diametrically opposite radially projecting bosses to the front non-swivelable remaining rest part in such a way as to produce a clamping-type connection of the two rest parts to the grip part in a self-locking manner. This self-locking clamping is released by moving the rear rest part in the radial direction. It has been found that this self-locking clamping of the two rest parts on the grip part can be released in the case of a high axial resting pressure on the rest parts, in particular the rear rest part, on account of the existing lever arm to the swivel axis, and thereby the hand rest can unintentionally open. The object of the present invention is to provide a handle grip of the type mentioned in the introduction in which an unintentional opening of the hand rest due to axial pressure on the latter is prevented.

SUMMARY OF THE INVENTION

According to the invention, there is provided a handle grip for drivable construction machines, agricultural machines and the like, with a grip part, with an upper end forming a receptacle for switch units and with a hand rest. The hand rest position can be adjusted along a shaft of the grip part and can be detachably clamped to the latter. The hand rest has front and rear rest parts that are pivotally connected, wherein the two rest parts can be moved relative to one another in the axial direction so as to effect a locking and unlocking of their relative pivotability.

By means of the measures according to the invention, for a swivelling movement of one of the rest parts, preferably the rear rest part, to occur, first of all a locking action acting in the radial direction between the two rest parts must be released before for example the rear rest part can be swivelled relative to the front rest part. This reliably prevents an unintentional release of the rest parts on the grip part, since due to the axially gripping and radially acting locking action, the rest parts cannot be unintentionally released simply by axial pressure on them.

A preferred structural embodiment of the mutual locking action of the two rest parts is given by forming the swivelable rear rest part in two parts, a lower element being swivelably coupled to the front rest part and an upper element forming a region of a hand rest surface being axially movable with respect to the lower element. The rear rest part is designed as two parts, both of which can move relative to one another in the axial direction. This means that an active axial movement of the upper element of the rear rest part relative to its lower element, which remains in the preset swivel position, is necessary to release the locking action.

A preferred structural embodiment of the locking action of the two rest parts in the axial direction to one another is given by providing the upper element of the swivelable rear rest part with axial lock bars that axially engage in undercuts on the front rest part.

Further advantageous modifications, in particular also as regards the clamping of the rest parts on the grip part, are also provided. A left-hand/right-hand usability of the hand rest can also be provided.

A structural configuration that is technically simple to implement is given by forming the grip part by two semi-shells. This gives a simple installation of the individual switch units.

BRIEF DESCRIPTION OF THE DRAWINGS

Further details of the invention are given in the following description, in which the invention is described and explained in more detail with the aid of the embodiment shown in drawings, in which.

DESCRIPTION OF THE INVENTION

Figure 1:
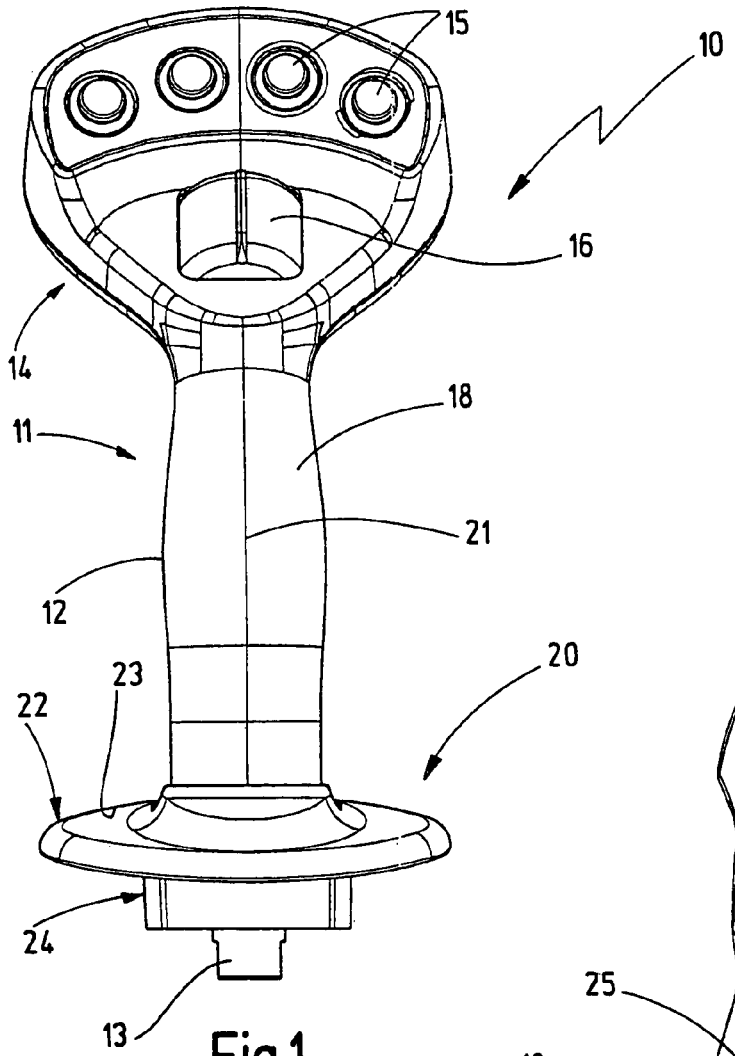
FIG. 1 is a front view of a handle grip according to a preferred embodiment of the present invention.

The handle grip 10 shown in the drawings is intended in particular for installation and incorporation in driveable construction machines. The handle grip 10 is intended to be operated by the operator's thumb and/or fingers while the operating hand is supported in a resting manner.

Figure 2:
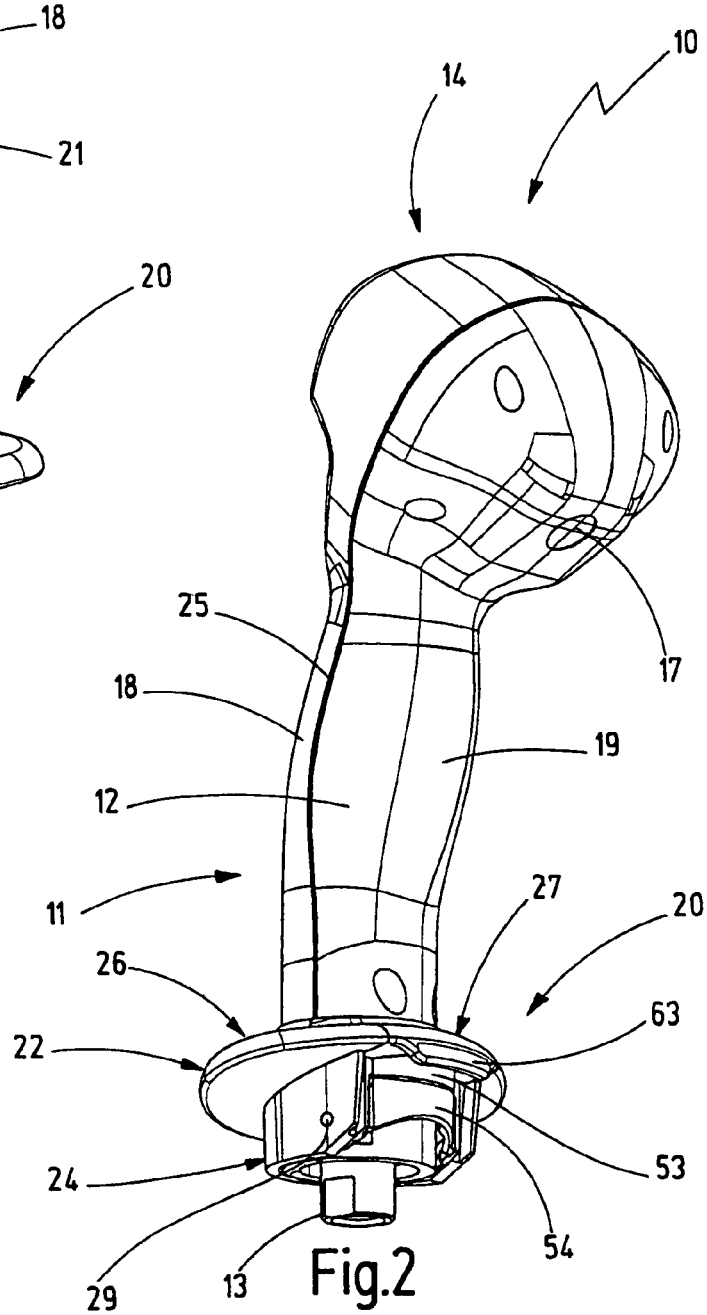
FIG. 2 is a perspective rear view of the handle grip according to FIG. 1.

The handle grip 10 comprises a grip part 11, the shaft 12 of which is grasped and enclosed by the operator's hand and can be connected via a hollow holding rod 13 to the relevant machine. The holding rod 13 may in this connection be part of a joystick arrangement. The holding rod 13 and shaft 12 are fixedly connected to one another in a manner not shown in detail. The shaft 12 is provided at its upper end with a receptacle 14 for various switch units 15, 16, 17. According to FIG. 2 the receptacle 14 for the switch units 15 to 17 is inclined relative to the alignment of the shaft 12 and of the holding rod 13. A hand rest 20 is arranged on the shaft 12 at its lower end facing towards the holding rod 13. The shaft 12 and the receptacle 14 of the grip part 11 are formed by two, in each case single piece semi-shells 18, 19, wherein the semi-shell 18 covers the front region and the semi-shell 19 covers the rear region of the handle grip 10 (FIG. 2). The two semi-shells 18 and 19 are formed as one piece from plastics material.

The hand rest 20 is in the embodiment shown symmetrical with respect to a longitudinal mid plane 21 (FIG. 1), which is rotated by 904 relative to the separating plane 25 of the two semi-shells 18 and 19. The hand rest 20 comprises a rest plate 22, which is roughly elliptically shaped in the direction transverse to the longitudinal mid plane 21, and the hand rest surface 23 of which in the lower region of the shaft 12 runs slightly inclined with respect to the separating plane 25 of the semi-shells 18 and 19. The hand rest surface 23 is eccentric with respect to the shaft 12 in such a way that the front region of the rest surface 23 is somewhat wider than the rear region. The rest plate 22 covers a guide sleeve 24 which surrounds the shaft 12.

Figure 3:
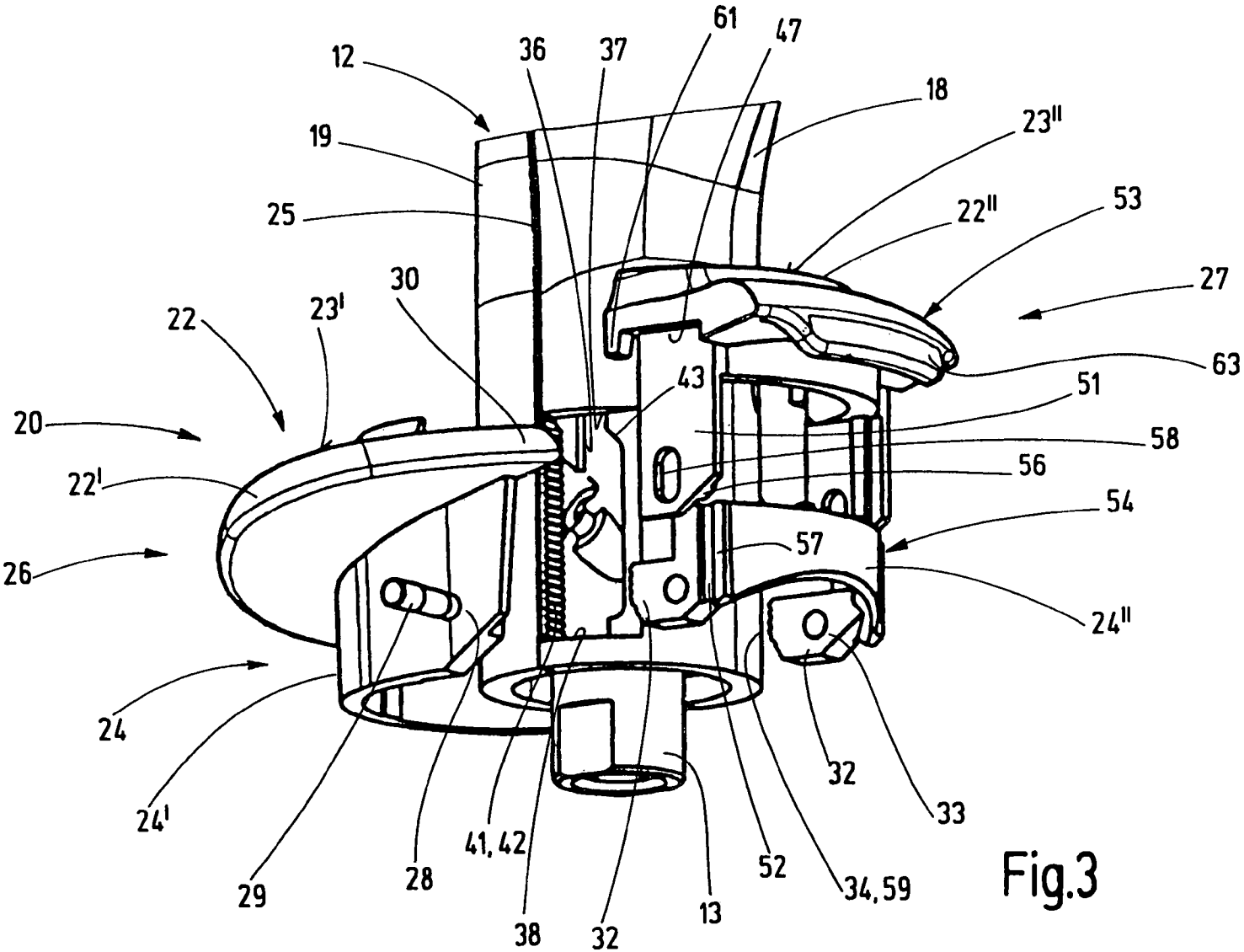
FIG. 3 shows on an enlarged perspective and partially exploded view the lower region of the handle grip according to FIG. 2 provided with the hand rest.

According to FIG. 3 the hand rest 20 is designed in two parts, and comprises a front rest part 26 and a rear rest part 27 held thereon and which can swivel in the direction of the double arrow A (in FIG. 4C) , and which in turn is formed as two parts. The rest plate 22 is thus in two parts (22' and 22"), while the radially inwardly displaced guide sleeve 24 is basically in three parts. The front rest part 26 consisting of the front rest plate part 22' and guide sleeve part 24' is, seen in the circumferential direction, the larger of the two rest parts, so that the rest plate part 22' and guide sleeve part 24' surround the shaft 12 over 180*s*, and is enlarged by cheek portions 30 and 28 running tangentially to the shaft 12. The rear swivelable rest part 27 fits into a roughly U-shaped and axially stepped recess of the front rest part 26 formed by the cheek portions, in such a way that a continuous internal and external circumferential surface is formed both on the internal circumferential side in the region of the guide sleeve 24 as well as on the external circumferential side in the region of the rest plate 22.

Figures 4A, 4B:
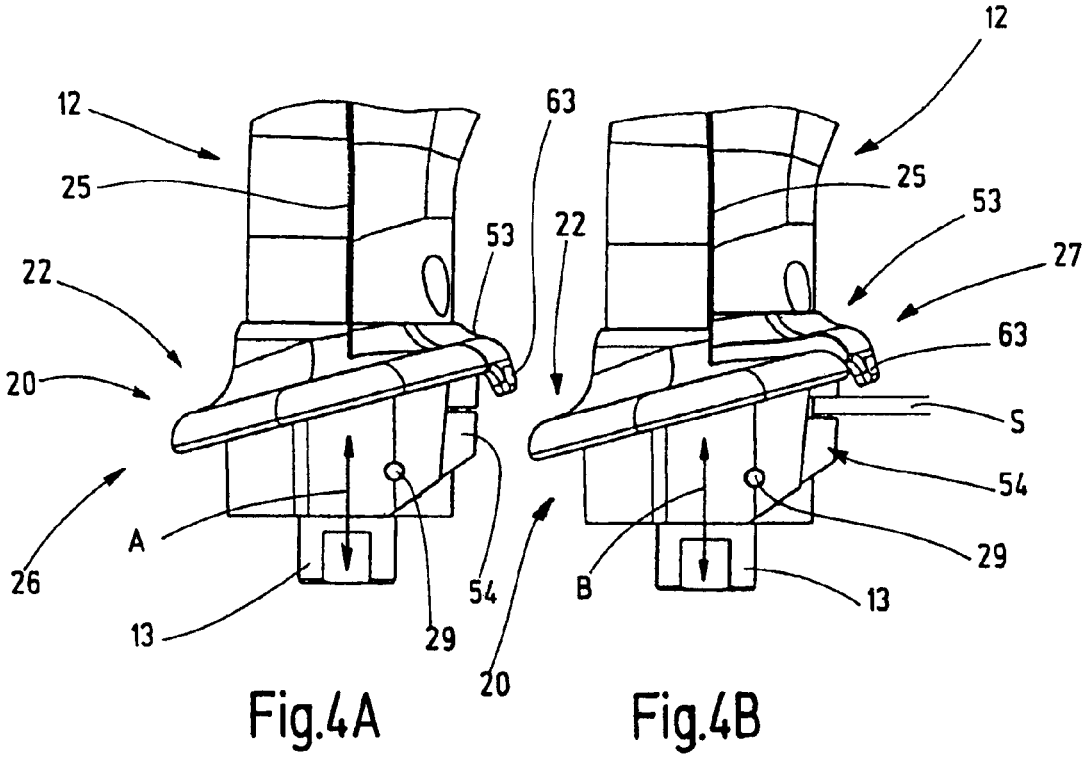
FIGS. 4A, 4B and 4C show in the assembled state and in a perspective side view the lower region of the handle grip according to FIG. 2 in various positions, namely in a locked clamped position and in an unlocked clamped position as well as in an unclamped swivelled position.

The swivelable rear rest part 27, which as already mentioned is in two parts, comprises an upper element 53 which is axially movable with respect to a lower element 54 in the direction of the double arrow B (FIG. 4B). Whereas the upper element 53 with its rest plate part 22' forms a region of the hand rest surface 23, the lower element 54 with its side cheek portions 52 serves to effect the swivelability in the direction of the double arrow A (FIG. 4C) with respect to the front rest part 26. For this purpose, holes for swivel axes 29 are made in the side cheek portions 52 of the lower element 54 and in the cheek portions 28 of the guide part 26. The upper element 53 comprises a guide sleeve part 24" and two diametrically oppositely facing axial side cheek portions 51 formed thereon. The two elements 53 and 54 are guided on one another in the axial direction on their side cheek portions 51 and 52 and are movably fixedly connected to one another in the swivelling direction according to the double arrow A. For this purpose the side cheek portions 51 of the upper element 53 comprise axial strips 56 (FIG. 3) that are inserted into axial grooves 57 of oppositely facing outer surfaces of the side cheek portions 52 of the lower element 54 (FIG. 3). The axial relative movement of the upper element 53 with respect to the lower element 54 is limited by an oblong hole 58 in the side cheek portions 51 of the upper element 53, through which hole passes the respective swivel axis 29. The arrangement is designed so that the side cheek portions 51 of the upper element 53 are arranged between the side cheek portions 52 of the lower element 54 and the guide sleeve part 24' of the front rest part 26.

In the region of the two diametrically opposite swivel axes 29 the rear semi-shell 19 of the shaft 12 is provided with two identical diametrically opposite running recesses 36. The axial length of the recesses 36 defines via their upper and lower boundary edges 37, 38 the extent of the axial adjustability of the hand rest 20 with respect to the shaft 12. In the circumferential direction each recess 36 is bounded by a clamping edge 41 running parallel to and roughly in the separating plane 25 of the two semi-shells 18 and 19 in the lower shaft region, which edge is provided with a transversely running toothed section 42. The oppositely facing edge 43 in each case has a torsionally rigid surface running parallel to the longitudinal mid plane 21, the plane of the said surface running in the region of the inside of the clamping edge 41.

In the region of the swivel axes 29 the side cheek portions 52 of the lower element 54 of the rear rest part 27 in each case include a boss 32 through which the hole for the swivel axis 29 radially passes and which abuts with its inner surface 33 against the edge 43 of the recess 36. In this way, the hand rest cannot swivel with respect to the shaft 12. Perpendicular to the inner surface 33 and facing towards the toothed clamping edge 41, the boss 52 has on the front side an eccentric edge 34 that is provided with a complementary toothed section 59 running transversely to the toothed section 42, and which after a swivelling movement of the rear rest part 27 and its lower element 54 to the front rest part 26 according to the arrow A, abuts in a clamping manner against the clamping edge 41. In this connection the eccentric contour of the surface of the eccentric edge 34 with respect to the swivel axis 29 is such as to produce a self-retaining clamping of the hand rest 20 on and around the shaft 12. This clamping also produces an interengagement of the toothed section 42 of the clamping edge 41 and the toothed section 59 of the boss 30 of the side cheek portions 52. At the same time the gap between the front rest part 26 and the circumferential region of the shaft 12 becomes practically zero. In this way a practically continuous adjustment, corresponding to the very small width of the toothed section, is achieved in the self-locking retention of the hand rest 20 along the shaft 12 of the order of magnitude of the axial length of the recess 36.

Figure 4C:
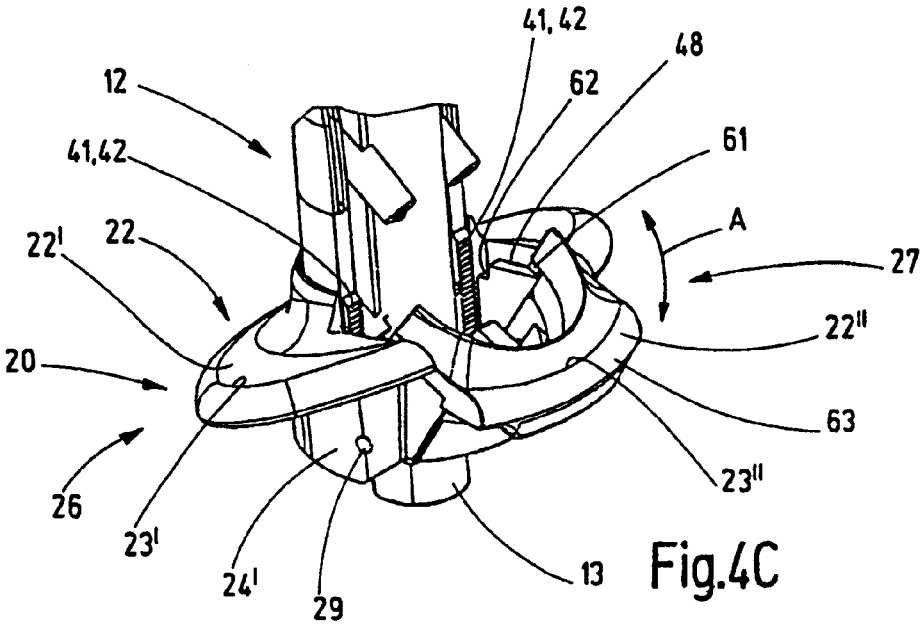

FIGS. 4A, 48 and 4C illustrate a release of the clamping and locking retention of the hand rest 20 on the shaft 12. FIG. 4A shows the clamping situation, in which the rest surface regions 23' and 23" of the rest plate parts 22' and 22" lie in one plane. If the upper element 53 of the rear rest part 27 is moved axially upwardly in the direction of the arrow B, then diametrically oppositely facing stop lugs 61 (FIGS. 3 and 4C) on the lower side 47 of the rest plate part 22" disengage from axial stop lugs 62 (FIG. 4C) of the upper edge 48 of the guide sleeve 24' of the front rest part 26, which hitherto (in the position of FIG. 4A) in the catch-type locked state have ensured a non-swivelability of the rear rest part 27 with respect to the front rest part 26, by means of an axial engagement. In the position shown in FIG. 4B, the upper element 53 is axially lifted from the lower element 54, so that a gap S is formed therebetween; also, the rear rest part 27 is swivelable in the direction of the arrow A, in that the upper element 53 can be swivelled for example on a lower gripping strip 63 outwardly around the swivel axes 29. Due to the strip/groove locking engagement 56, 57 between the upper element 53 and the lower element 54, the lower element 54 is entrained by the swivelling movement of the upper element 53 so that the position according to FIG. 4C results. The hand rest 20 can thereby be moved and adjusted in the axial direction with respect to the shaft 12. The clamping retention of the hand rest 20 on the shaft 12 takes place in the reverse order to that described hereinbefore, in other words the upper element 53 is swivelled together with the lower element 54 in the direction of the arrow A to the shaft 12, until the lower element 54 abuts against the shaft 12 and a clamping is thereby effected. The upper element 53, which is not involved in the clamping, can then be displaced axially downwardly with respect to the lower element 54 in the direction of the arrow B until the stop lugs 61 of the upper element 53 engage in stop grooves 62 of the front rest part 26.

It is understood that in the self-locking and clamping retention of the lower element 54 of the rear rest part 27 and overall of the front rest part 26 on and with respect to the shaft 12, an axial mobility of the upper element 53 with respect to the lower clamping element 54 and the shaft 12 is still retained.

What is claimed is:

1. A handle grip for driving a machine, comprising:

a shaft that extends along a primarily vertical axis and that forms a grip part;

a receptacle that lies at an upper end of said shaft and that holds switch units that face in a forward and upward direction; and a hand rest at a lower end of said shaft with said hand rest having front and rear rest parts, wherein said hand rest has front and rear rest parts that are radially and axially clampable to the shaft and pivotally connected to one another, and said rest parts are moveable parallel to said axis relative to one another to effect a radial and axial locking and unlocking of their pivotal connection, and wherein the pivotal rear rest part comprises:

a lower element that is swivelably coupled to the front rest part, thereby providing the radial locking of the pivotal connection, and an upper element forming a region of a hand rest surface and being axially movable with respect to the lower element, thereby providing the axial locking of the pivotal connection.

2. The handle grip according to claim 1, characterized in that the upper element of the swivelable rear rest part has axial lock bars that axially engage in undercuts on the front rest part.

3. The handle grip according to claim 1, characterized in that the lower element of the rear rest part is connected via a swivel axis to a guide sleeve of the front rest part facing away from the rest surface.

4. The handle grip according to claim 1, characterized in that the upper element of the rear rest part is provided with an axial oblong hole through which passes the swivel axis.

5. The handle grip according to claim 4, characterized in that the upper element of the rear rest part is provided with axial guide webs, which include the oblong hole and which are in each case arranged between the lower element of the rear rest part and the guide sleeve of the front rest part.

6. The handle grip according to claim 3, characterized in that the upper element and the lower element of the swivelable rear rest part are axially guided and connected in a swivelable manner by inter-engaging, axially running guide strips and guide grooves.

7. The handle grip according to claim 1, characterized in that the upper element of the rear receptacle part and the guide sleeve of the front receptacle part directly underneath the rest surface are provided with axial surfaces, which arc provided with the lock bar and the undercut.

8. The handle grip according to claim 1, characterized in that the shaft in the region of the displacably retained hand rest is provided at one or two diametric regions with a recess, in which one of the two rest parts of the hand rest engages, an edge of the recess being provided with a toothed section on which engages a damping edge of the lower element of the swivelable rear rest part.

9. The handle grip according to claim 8, characterized in that the clamping edge of the lower element of the swivelable rear rest part is provided with a counter- toothed section.

10. The handle grip according to claim 8, characterized in that the clamping edge runs in a swivel direction eccentrically and in a self-locking manner with respect to the swivel axis.

11. The handle grip according to claim 8, characterized in that the lower element of the swivelable rear rest part is provided with a radially inwardly aligned boss which includes the toothed clamping edge and which forms a counter surface to a guide surface of a second edge of the recess and is provided with a hole for the swivel axis.

12. The handle grip according to claim 1, characterized in that the hand rest is symmetrical with respect to a longitudinal mid plane of the grip part.

13. The handle grip according to claim 1, characterized in that the grip part is formed by two semi-shells.

* * * * *